United States Patent [19]

Lehman

[11] Patent Number: 4,644,713

[45] Date of Patent: Feb. 24, 1987

[54] POST ANCHOR DEVICE

[75] Inventor: John F. Lehman, Canfield, Ohio

[73] Assignee: The Steel City Corporation, Youngstown, Ohio

[21] Appl. No.: 824,279

[22] Filed: Jan. 30, 1986

[51] Int. Cl.[4] ..... E02D 27/42

[52] U.S. Cl. ..... 52/165; 52/298

[58] Field of Search ..... 52/165, 155, 298, 296

[56] References Cited

U.S. PATENT DOCUMENTS

| | | | |
|---|---|---|---|
| 427,815 | 5/1890 | Wolf | 52/165 |
| 513,115 | 1/1894 | Kiler | 52/165 X |
| 844,726 | 2/1907 | Hunter | 52/165 |
| 870,752 | 11/1907 | White | 52/165 |
| 891,448 | 6/1908 | Snider | 52/165 X |
| 4,156,332 | 5/1979 | Thompson | 52/165 |
| 4,271,646 | 6/1981 | Mills | 52/165 |

FOREIGN PATENT DOCUMENTS

| | | | |
|---|---|---|---|
| 2030613 | 4/1980 | United Kingdom | 52/165 |

*Primary Examiner*—Alfred C. Perham
*Attorney, Agent, or Firm*—Harpman & Harpman

[57] ABSTRACT

A post anchor to rapidly mount a post within the ground has a post end engagement bracket from which extends an anchor stake. The anchor stake is driven into the ground and the post is then inserted into the upstanding end of the post engagement bracket.

1 Claim, 3 Drawing Figures

POST ANCHOR DEVICE

BACKGROUND OF THE INVENTION

1. Technical Field

This invention relates to post anchor systems that are used to support a post in the ground by use of a support bracket.

2. Description of the Prior Art

Prior art devices of this type have relied on a variety of different structures to mount posts. See for example U.S. Pat. Nos. 427,815, 4,156,332, 844,726, 870,752 and 4,271,646.

In U.S. Pat. No. 427,815, a bottom for fence posts is disclosed having a U-shaped channel upper portion and a cross sectionally T-shaped lower portion that is driven into the ground. A post is bolted within the channel portion with the post resting on the lower portion.

U.S. Pat. No. 4,156,332 discloses a post assembly having a stake portion and a post support platform with an upstanding angular member thereon. An alternate form of the invention discloses a pair of oppositely disposed apertured plates with integrally formed downturned extending ground engaging angles.

U.S. Pat. No. 844,726 discloses a fence post setting tool having a hollow pointed stake portion with a post receiving socket formed in the opposite end.

In U.S. Pat. No. 870,752 a clothes line prop is disclosed wherein a cylindrical socket having a back plate and side flanges.

U.S. Pat. No. 4,271,646 discloses a post support means having a stake formed of cross angular members and a post receiving socket on one end thereof.

SUMMARY OF THE INVENTION

A post anchor device to rapidly position and support a post in the ground. The post anchor device has a tubular ground engaging portion and a post receiving portion. The ground engaging portion has a tapered end that is securely driven into the ground. The post receiving portion has an upstanding bracket into which the post is positioned and secured into by fasteners.

DESCRIPTION OF THE PREFERRED EMBODIMENT

Figure 1:
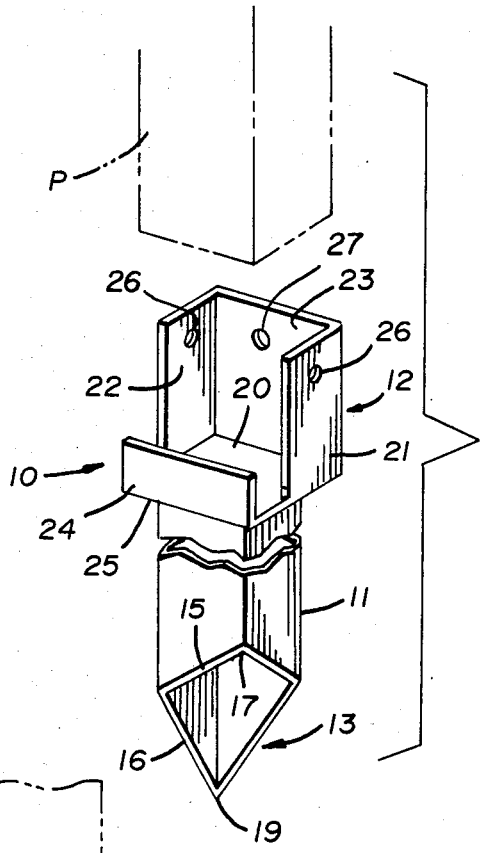
FIG. 1 is a perspective view of the post anchor with a post shown in broken lines positioned above for engagement within.
Figure 2:
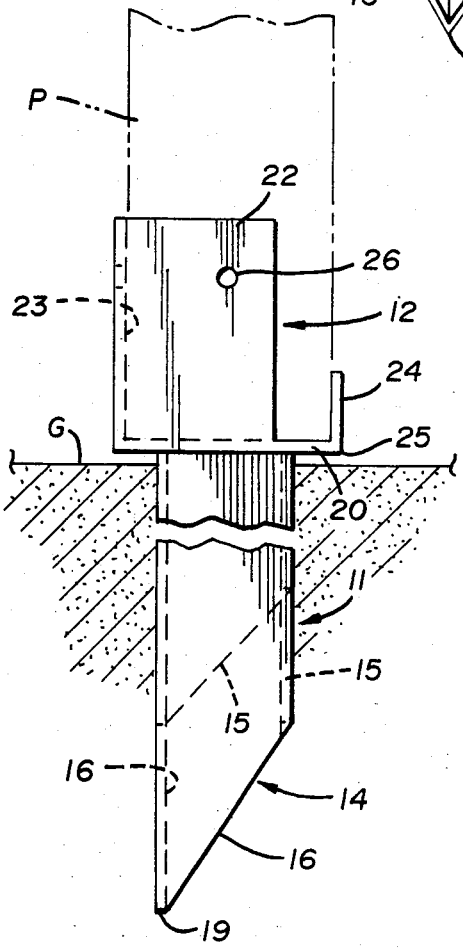
FIG. 2 is a side plan view of the post anchor.
Figure 3:
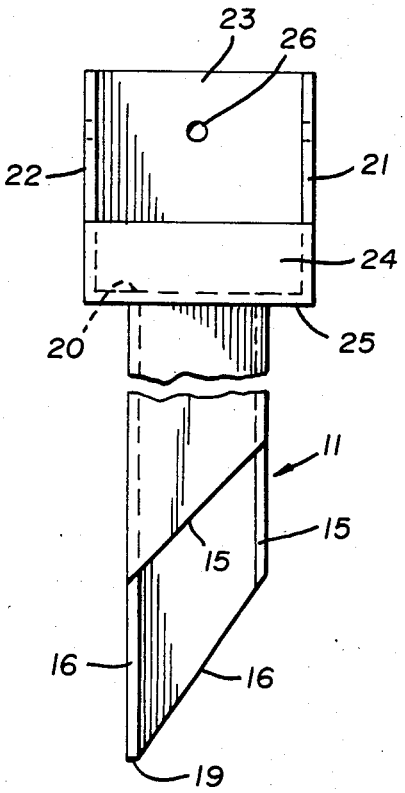
FIG. 3 is a front plan view of the post anchor.

Referring to FIGS. 1 and 2 of the drawings, a post anchor 10 can be seen comprising an elongated tubular member 11 extending from a post support bracket 12. The elongated tubular member 11 has a pointed end 13 defined by an angularly disposed transverse cut at 14.

The cut at 14 has two pairs of unequal length angular edges 15 and 16. The angular edges 15 extend upwardly joining together at a point 17 while the angular edges 16 extend downwardly to the ground engaging point at 19.

The post support bracket 12 comprises a generally square base plate 20 secured to the upper end of the tubular member 11. The base plate 20 has upstanding oppositely disposed side members 21 and 22 interconnected to one another by an upstanding back plate 23. Each of the side members 21 and 22 are of an equal length and height with the back plate 23 having an unequal length.

A flange 24 extends upwardly from a base edge 25 in oppositely disposed relation to said back plate 23. The flagne 24 is of a height less than half of said side members and said back plate 21, 22 and 23 respectively and is spaced in relation thereto as best seen in FIG. 2 of the drawings. Each of the side members 21 and 22 have an aligned aperture within at 26 and said back plate 23 is also apertured on the same horizontal plane at 27.

In operation, the post anchor 10 is driven into the ground G until engagement of the base 20 is achieved. A post (P) shown in broken lines in FIGS. 1 and 2 of the drawings is aligned within the post support bracket 12 providing multiple axis support and guidance on both the horizontal and vertical planes.

Fasteners (not shown) are passed through the aligned apertures 26 and the post P securing the same within the confines of the bracket 12. The flange 24 restricts initial lateral movement of the post P before it is fastened into place. The space between the flange 24 and the respective side members 21 and 22 provides a visual representation of the relative position of the post P as it is positioned within the post support bracket 12 to clearly indicate the proper seating of the post P against the base plate 20 which is critical.

It will thus be seen that a new and novel post anchor device has been illustrated and described and that various changes and modifications may be made therein without departing from the spirit of the invention and having thus described my invention,

What I claim is:

1. A post anchor to mount post in the ground comprising a support bracket having an elongated tubular member extending therefrom, said support bracket having a base, at least three upstanding members extending from said base, said upstanding members being interconnected and of the same height, two of said upstanding members being oppositely disposed to one another and of an equal width, a flange extending from said base in oppositely disposed spaced relation to said other of said upstanding members, and in spaced relation to said two upstanding members for lateral alignment with a post position in said support bracket, said means on said tubular member for progressively engaging and penetrating said ground.

* * * * *